US005722680A

United States Patent [19]

Dodge

[11] Patent Number: 5,722,680

[45] Date of Patent: Mar. 3, 1998

[54] STEP-IN SNOWBOARD BINDING

[75] Inventor: David J. Dodge, Williston, Vt.

[73] Assignee: The Burton Corporation, Burlington, Vt.

[21] Appl. No.: 655,021

[22] Filed: May 29, 1996

[51] Int. Cl.[6] ..... A63C 9/00

[52] U.S. Cl. ..... 280/624; 280/14.2; 280/607

[58] Field of Search ..... 280/684, 625, 280/617, 618, 607, 14.2, 633

[56] References Cited

U.S. PATENT DOCUMENTS

| | | |
|---|---|---|
| Re. 26,972 | 10/1970 | Spademan . |
| Re. 33,350 | 9/1990 | Stuart . |
| 3,140,877 | 7/1964 | Spademan . |
| 3,271,040 | 9/1966 | Spademan . |
| 3,280,411 | 10/1966 | Brock . |
| 3,494,628 | 2/1970 | Spademan . |
| 3,545,103 | 12/1970 | Bloomfield et al. . |
| 3,560,011 | 2/1971 | Spademan . |
| 3,797,841 | 3/1974 | McAusland . |
| 3,824,713 | 7/1974 | Vaccari . |
| 3,852,896 | 12/1974 | Pyzel et al. . |
| 3,869,136 | 3/1975 | Jackson . |
| 3,884,492 | 5/1975 | Spademan . |
| 3,888,497 | 6/1975 | Zahradka . |
| 3,900,204 | 8/1975 | Weber . |
| 3,944,240 | 3/1976 | Bodendorfer . |
| 3,957,280 | 5/1976 | Turnheim et al. . |
| 3,972,134 | 8/1976 | Kastinger . |
| 3,988,841 | 11/1976 | Salomon . |
| 4,026,045 | 5/1977 | Druss . |
| 4,042,257 | 8/1977 | Salomon . |
| 4,155,179 | 5/1979 | Weninger . |
| 4,177,584 | 12/1979 | Bevl . |
| 4,182,525 | 1/1980 | Spademan . |
| 4,270,770 | 6/1981 | Spademan . |
| 4,352,508 | 10/1982 | Spademan . |
| 4,387,517 | 6/1983 | Annovi . |
| 4,395,055 | 7/1983 | Spademan . |
| 4,403,785 | 9/1983 | Hottel . |
| 4,492,387 | 1/1985 | Spademan . |
| 4,652,007 | 3/1987 | Dennis . |
| 4,669,202 | 6/1987 | Ottieri . |
| 4,728,116 | 3/1988 | Hill . |
| 4,741,550 | 5/1988 | Dennis . |
| 4,964,649 | 10/1990 | Chamberlin . |
| 4,973,073 | 11/1990 | Raines et al. . |
| 4,979,760 | 12/1990 | Derrah . |
| 5,016,902 | 5/1991 | Goud et al. ..... 280/625 |
| 5,028,068 | 7/1991 | Donovan . |
| 5,035,443 | 7/1991 | Kincheloe . |

(List continued on next page.)

FOREIGN PATENT DOCUMENTS

| | | |
|---|---|---|
| 0 397 969 A1 | 11/1990 | European Pat. Off. . |
| 0 669 147 A2 | 8/1995 | European Pat. Off. . |
| 2 628 981 | 9/1989 | France . |
| 2 644 074 | 9/1990 | France . |
| 2 652 753 | 4/1991 | France . |
| 2 689 776 | 10/1993 | France . |
| 3910156 A1 | 10/1990 | Germany . |
| 4344647 A1 | 6/1995 | Germany . |
| 7-3-3728 | 11/1995 | Japan . |
| 7-303728 | 11/1995 | Japan . |
| 678494 A5 | 9/1991 | Switzerland . |
| WO 96/05894 | 2/1996 | WIPO . |
| WO 96/26774 | 9/1996 | WIPO . |

OTHER PUBLICATIONS

Regno d'Italia, Ministero Delle Coporazioni, Ufficio Della Propriet Á Intell/etuale, Brevetto Industriale N. 322456 Aldo Marzot, Stampato nel dicembre 1935—A. XIV.

*Primary Examiner*—Brian L. Johnson
*Assistant Examiner*—Min Yu
*Attorney, Agent, or Firm*—Wolf, Greenfield & Sacks, P.C.

[57] ABSTRACT

A snowboard binding for securing a boot to a board, comprising a base, a first engagement member that is supported by the base and adapted to engage a first lateral side of the boot, and a second engagement member, pivotally mounted to the base, that is adapted to engage a second lateral side of the boot opposite the first lateral side of the boot.

83 Claims, 10 Drawing Sheets

U.S. PATENT DOCUMENTS 5,044,654 9/1991 Meyer .
5,044,656 9/1991 Peyre .
5,054,807 10/1991 Fauvet .
5,069,463 12/1991 Baud et al. .
5,085,455 2/1992 Bogner et al. .
5,094,470 3/1992 Riedel .
5,121,939 6/1992 Peyre ..... 280/625
5,143,396 9/1992 Shaanan et al. .
5,145,202 9/1992 Miller .
5,172,924 12/1992 Barci .
5,188,386 2/1993 Schweizer .
5,213,356 5/1993 Rohrmoser ..... 280/607
5,232,241 8/1993 Knott et al. .
5,236,216 8/1993 Ratzek .
5,299,823 4/1994 Glaser .
5,344,179 9/1994 Fritschi et al. .
5,354,088 10/1994 Vetter et al. .
5,401,041 3/1995 Jespersen .
5,409,244 4/1995 Young .
5,417,443 5/1995 Blattner et al. .
5,474,322 12/1995 Perkins et al. .
5,480,176 1/1996 Sims .
5,499,461 3/1996 Danezin et al. .
5,505,477 4/1996 Turner et al. .
5,544,909 8/1996 Lauglin et al. ..... 280/617

STEP-IN SNOWBOARD BINDING

BACKGROUND OF THE INVENTION

1. Field of the Invention

The present invention relates to a snowboard binding for interfacing a boot to a snowboard.

2. Discussion of the Related Art

Most conventional binding systems for soft snowboard boots suffer from a disadvantage in that they are not "step-in" systems that can be automatically actuated by the rider simply stepping into the binding. These bindings typically include a rigid high back piece into which the heel of the boot is placed, and one or more straps that secure the boot to the binding. Such bindings can be somewhat inconvenient to use because after each run, the rider must unbuckle each strap to release the boot when getting on the chair lift, and must re-buckle each strap before the next run.

Other soft boot bindings have been developed that do not employ straps, but use rigid engagement members to releasably engage the boot to the binding. These systems typically include a handle or lever that must be actuated to move the engagement members into and out of engagement with the snowboard boot, and therefore, are not step-in systems that are automatically actuated by the rider simply stepping into the binding. The requirement that the handle or lever be mechanically actuated to lock the boot into the binding is disadvantageous because it makes it less convenient and more time consuming to engage the rider's boots to the snowboard each time the rider completes a run.

A further disadvantage of conventional bindings that employ rigid engagement members and an actuation handle or lever is that they generally employ a large spring that biases the binding to hold it in the closed position. Thus, to open the binding, the rider must exert substantial force on the handle or lever, making the binding difficult to use.

In view of the foregoing, it is an object of the present invention to provide an improved step-in binding for mounting a boot to a snowboard.

SUMMARY OF THE INVENTION

In one illustrative embodiment of the invention, a snowboard binding is provided for securing a boot to a snowboard. The binding comprises a base, a first engagement member that is supported by the base and adapted to engage a first lateral side of the boot, and a second engagement member, pivotally mounted to the base, that is adapted to engage a second lateral side of the boot opposite the first lateral side of the boot.

In another illustrative embodiment of the invention, the snowboard binding is provided with a trigger that is adapted to receive the bottom of the snowboard boot and, when moved via contact with the boot, to cause the pivotal engagement member to pivot into engagement with the snowboard boot.

BRIEF DESCRIPTION OF THE DRAWINGS

The invention will be better understood and appreciated from the following detailed description of illustrative embodiments thereof, and the accompanying drawings, in which.

DETAILED DESCRIPTION

The present invention is directed to a method and apparatus for engaging a snowboard boot to a snowboard. In accordance with one illustrative embodiment of the invention, a binding is provided that is automatically closed when a rider steps into the binding. Furthermore, the binding advantageously provides substantial locking force while requiring a small opening force.

Figure 1:
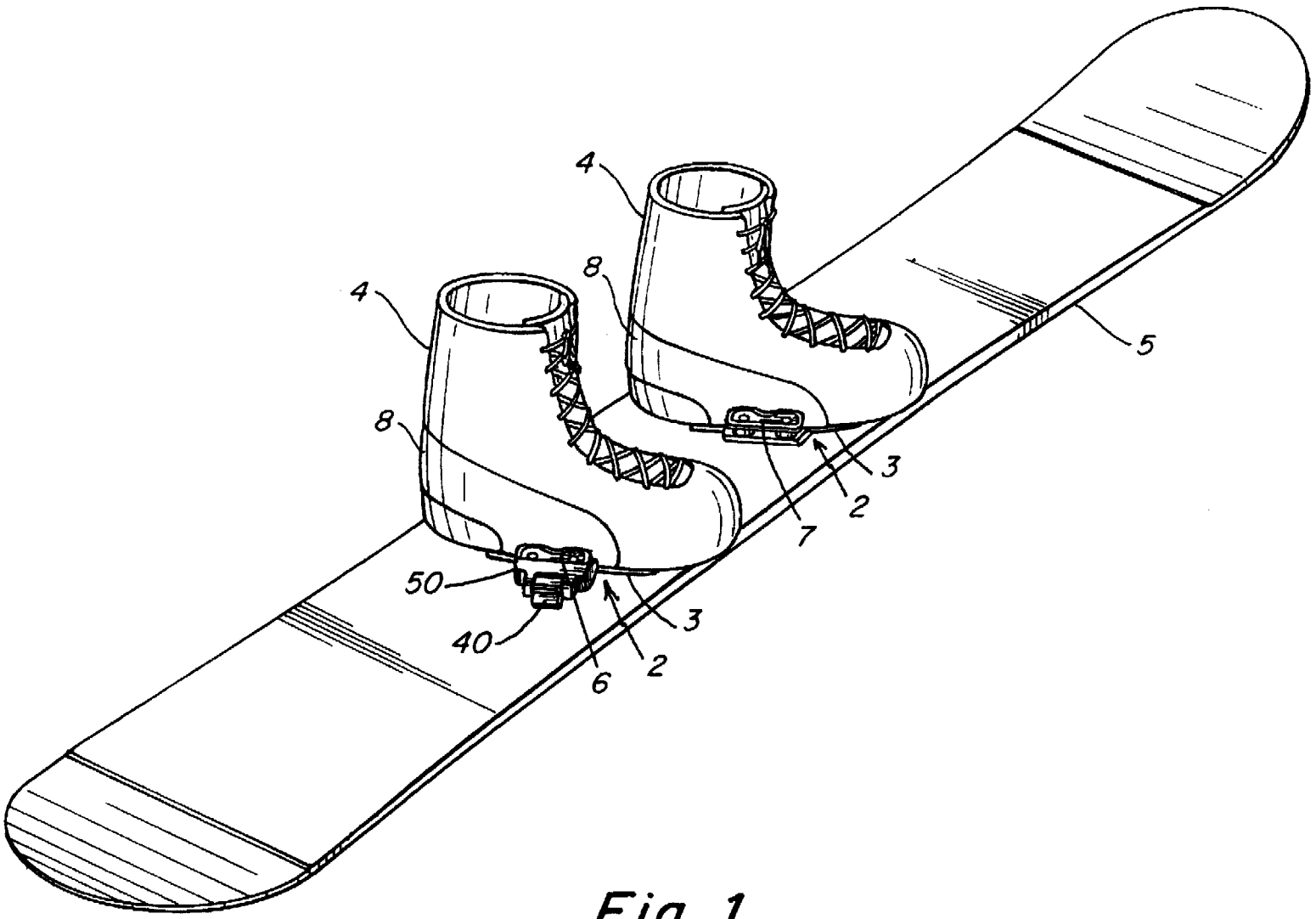
FIG. 1 is a perspective view of two bindings in accordance with the present invention, each mounted on a snowboard and receiving a boot.

FIG. 1 is a perspective view of a pair of snowboard boots 4 mounted to a snowboard 5 via a pair of bindings 2 in accordance with one illustrative embodiment of the present invention. The bindings each may include a hold down disc, discussed below, that enables the angle of the rider's feet relative to the longitudinal axis of the snowboard to be adjusted to a position that the rider finds most comfortable. The bindings 2 each includes a pair of engagement members for engaging the lateral sides of the boots, and a handle 40. The binding is constructed and arranged so that the engagement members automatically lock the boot 4 in the binding when the rider steps into the binding, without requiring actuation of the handle 40. The handle 40 is used only to move the binding from a locked position to an unlocked position, and can do so without substantial force from the rider.

The binding of the present invention enables quick and easy engagement and disengagement of the rider's boots with the board. Before beginning a run, the rider simply steps into the bindings 2, which causes the engagement members to automatically secure the boots 4 to the board 5. At the completion of the run, the rider can lift the handle 40 of the rear binding to disengage the binding and free the rear boot, thereby enabling the rider to use the rear leg to push the snowboard along the chair lift. After the handle 40 is lifted and the rider steps out, the binding 40 automatically assumes the open position wherein it is prepared to receive and automatically engage the boot. Thus, after getting off the lift, the rider can simply step into the binding to automatically lock the boot in place, and begin the next run.

One illustrative embodiment of a binding 2 in accordance with the present invention is shown in FIGS. 2–10. The binding 2 includes a housing that includes a base plate 3 that is mounted to the snowboard and a cover 50 that covers the binding locking mechanism. The binding further includes a pair of engagement members 6 and 7 that are mounted to the housing. In the embodiment shown, engagement member 7 is fixed to baseplate 3 and engagement member 6 is movable, and in particular pivotable, with respect thereto. The binding is adapted to engage a snowboard boot 4 having lateral recesses 54 on either side for receiving the engagement members 6 and 7. The lateral recesses 54 may be provided in the boot via an interface 8, as described in co-pending U.S. patent application Ser. No. 08/584,053 which is incorporated herein by reference, which is a single-piece molded plastic part bonded to the sole of the boot. However, it should be understood that the invention is not limited in this respect, and that the binding of the present invention can be used with boots that are adapted in other ways to engage the binding.

Figure 2:
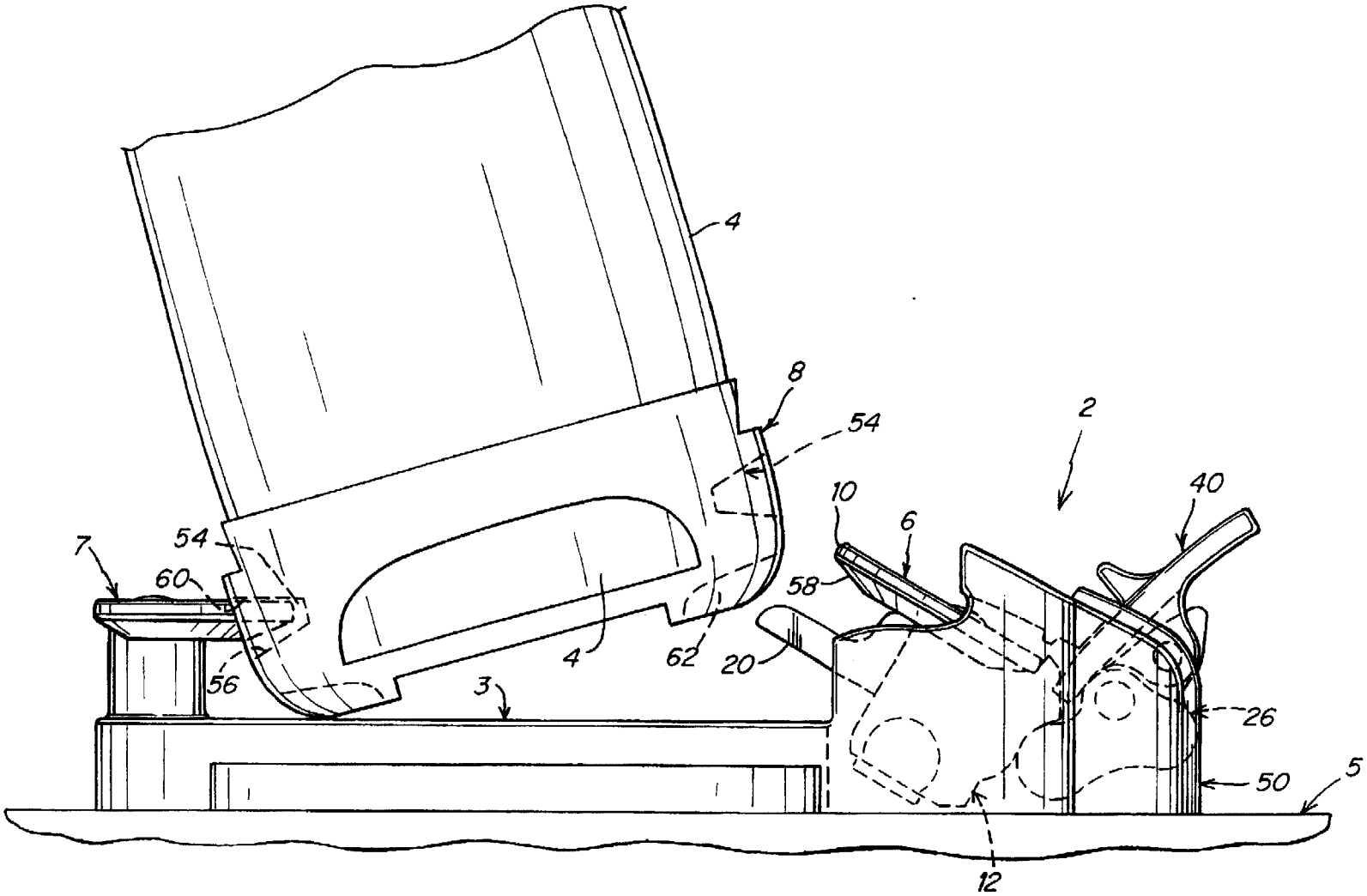
FIG. 2 is a rear view of a boot stepping into a binding in accordance with the present invention.
Figure 7:
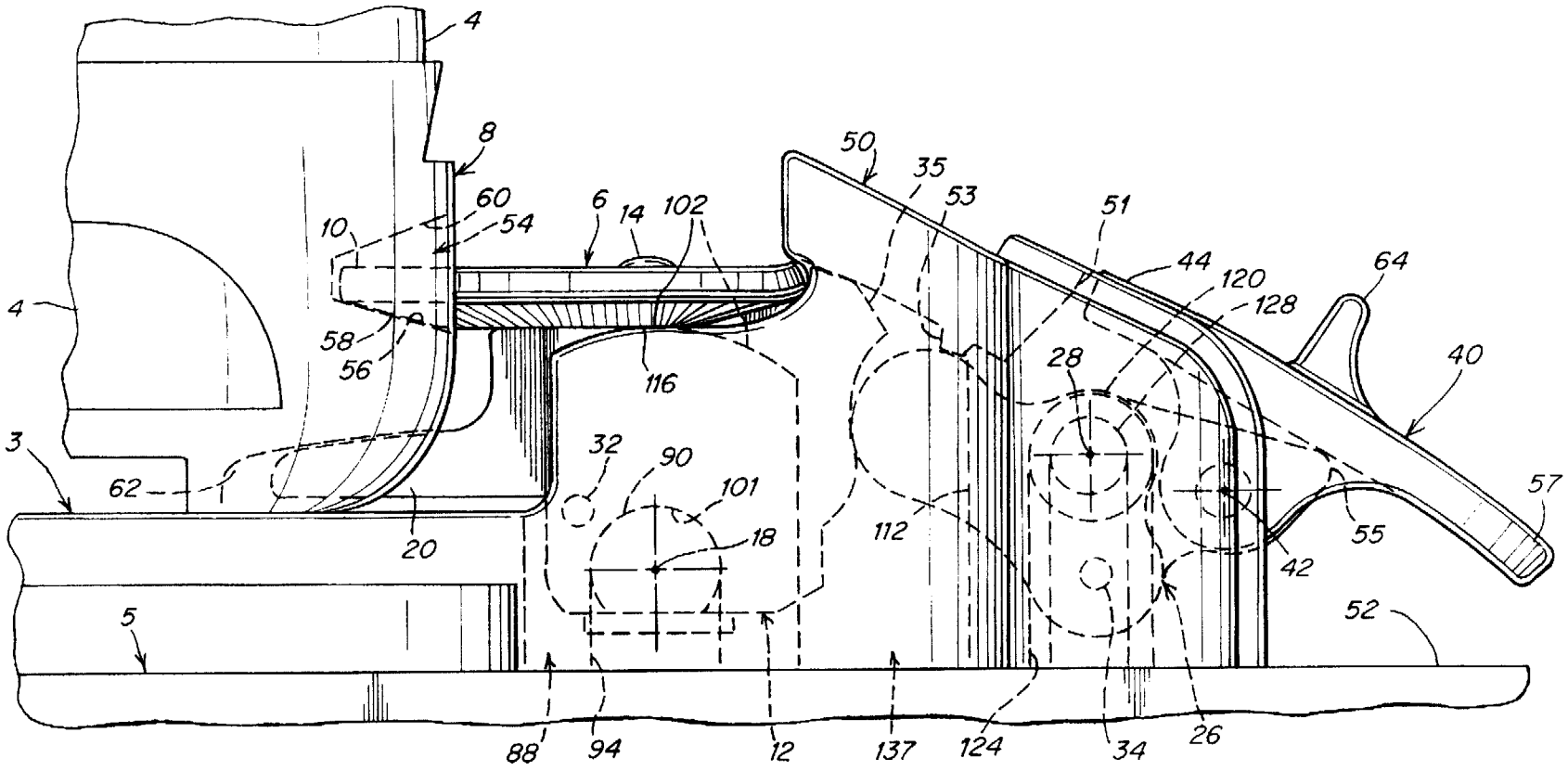
FIG. 7 is a partial rear view of the boot and binding of FIGS. 3–6, in which the binding is in the closed position and in which the cover and the handle are illustrated in the ready to ride position.

The rider steps into the binding by first aligning the fixed engagement member 7 with the recess 54 on the inside of the boot. As shown in FIG. 2, the engagement member 7 is arranged in a substantially horizontal configuration that extends substantially parallel to the baseplate 3 and the snowboard. Thus, the boot 4 is angled slightly when bringing the recess 54 into contact with the engagement member 7. To facilitate this process, the upper surface 60 of the recess is angled upwardly from the back of the recess to the edge of the boot, and the lower surface 56 of the recess is angled downwardly so that the recess is widened at its outer periphery to make it easier to insert the engagement member 7 into the recess. The lower surface 58 (FIG. 3) of the end 10 of each engagement member 6 and 7 may also be angled upwardly at the same angle that the lower surface 56 of the recess is angled downwardly to further facilitate mating of the recess with the engagement member. As seen in FIG. 7, the lower surface 58 of the engagement member lies flush against the lower surface 56 of the recess when the binding is closed. Examples of angles suitable for the recess surfaces and the engagement member include angles ranging from ten to twenty-five degrees. However, it should be understood that the present invention is not limited to any particular range of angles, or even to requiring that the recess and/or engagement member be angled at all. All that is required is that the engagement member and recess have compatible shapes that enable the rider to step into the binding and to provide sufficient engagement forces to hold the boot in the binding.

After the recess 54 on the inside of the boot is mated with the fixed engagement member 7, the rider steps down on a trigger 20 disposed on the other side of the binding. The trigger 20 is mechanically coupled to the movable engagement member 6 in a manner described below, such that when the rider steps down on the trigger 20, the end 10 of member 6 is moved into engagement with the recess 54 on the outside of the boot. In one embodiment of the invention, the binding includes an active locking mechanism so that after the rider steps down on the trigger and advances it past a bistable trigger point, the locking mechanism actively brings the movable engagement member 6 into a fully closed position wherein the binding is closed and the boot is held between the engagement members 6 and 7. Thereafter, the binding can be opened by lifting the handle 40 in the manner described below.

In the embodiment shown in the figures, the boot 4 is provided with a sole recess 62 that is adapted to receive the trigger 20. This recess can be provided in the interface 8, or in any number of other ways. The recess 62 permits the bottom of the boot to sit flat on the binding plate 3 when the binding is fully closed, as seen in FIGS. 5–8, without interference from the trigger 20. Furthermore, the rider can use the recess 62 to align the boot with the binding to ensure that the boot is properly positioned to receive the end 10 of the engagement member 6 when the rider steps down on the trigger. However, although the sole recess provides these advantages, it should be understood that the invention is not limited to use with a boot that includes such a recess. For example, the binding mechanism can be constructed so that the trigger does not extend parallel to the binding plate in the locked position, but rather, is received in a recess provided in the binding plate when the binding is in the locked position.

One illustrative embodiment of a locking mechanism for use in a binding in accordance with the present invention is shown in FIGS. 3–8, which are partial rear views illustrating a boot stepping into the binding so that the binding moves from the open to the closed position. The locking mechanism includes a rocker 12 that mechanically couples the engagement member 6 to the trigger 20. The rocker is pivotally mounted, about an axis 18, within a binding cover 50 that is cut away in FIGS. 3–6, but shown in FIGS. 7 and 8. The trigger 20 and rocker 12 can be formed from a single molded plastic piece. In the embodiment shown, the engagement member 6 is a metal piece that is fixedly attached to the rotatable rocker 12 by a pair of rods 14 best shown in the exploded views of FIGS. 9 and 10. The rods 14 extend through holes in the engagement member 6 and rocker 12, and are peened over a washer (not shown) underneath the rocker. The fixed engagement member 7 (FIGS. 2 and 9–10) can be attached to the binding housing in the same manner. Furthermore, it should be understood that the engagement members can alternatively be attached to the binding in a number of other ways.

The rocker 12, engagement member 6 and trigger 20 are arranged so that when the binding is in the open position, the rider can step into the binding and onto the trigger 20 without interference from the engagement member 6. Furthermore, as the binding moves into the closed position, the member 6 is brought into engagement with the boot recess 54. In one embodiment of the invention, the rocker 12, and consequently the trigger 20 and engagement member 6 that are fixed thereto, rotates from the open to the closed position through an angle A (FIG. 3) equal to approximately thirty degrees. However, it should be understood that by altering the dimensions of the trigger 20 and engagement member 6, as well as the angle of rotation of the rocker, a number of different configurations can be achieved. All that is required is that the binding be arranged so that when it is in the open position, the rider can step into the binding and onto the trigger 20 without interference from the engagement member 6, and thereby cause the member 6 to be brought into engagement with the boot recess 54 as the boot is advanced into the binding.

The rocker, latch plate and trigger are preferably dimensioned and configured so that the boot, trigger and engagement member mesh together like a gear when the rider steps into the binding. As stated above, in one embodiment of the invention, the rocker rotates through an angle of approximately 30° between the open and closed positions, and the bottom surface of the end of the engagement member is angled at approximately 20° to match the lower surface 56 of the boot recess. The trigger is slightly longer than the engagement member, and in one embodiment is approximately twenty-five mm long. The shape of the sole recess 62 (FIG. 7) on the boot can be manipulated to control the rate at which the engagement member 6 closes as the boot steps down on the trigger. In the embodiment shown, the upper surface of the recess is arched from the inside of the foot to the outside, and matches a radius on the upper surface of the trigger. In the embodiment shown, the radius for each arc is approximately fifteen mm. The arc on the upper surface of the recess causes the engagement member to close more quickly than if the recess was formed in a rectangular shape.

The mechanism of the binding that locks the pivotal engagement member 6 into the closed position is now described making reference to FIGS. 3–10. The locking mechanism includes a cam 26 that is pivotally mounted within the binding cover 50, about an axis 28, in a manner described below. The cam 26 is arranged to enable the rocker to rotate from the open to the closed position. In the closed position, the cam engages the rocker 12 to prevent it and the engagement member 6 fixed thereto from rotating back to the open position unless and until the handle 40 is actuated to open the binding.

Figure 3:
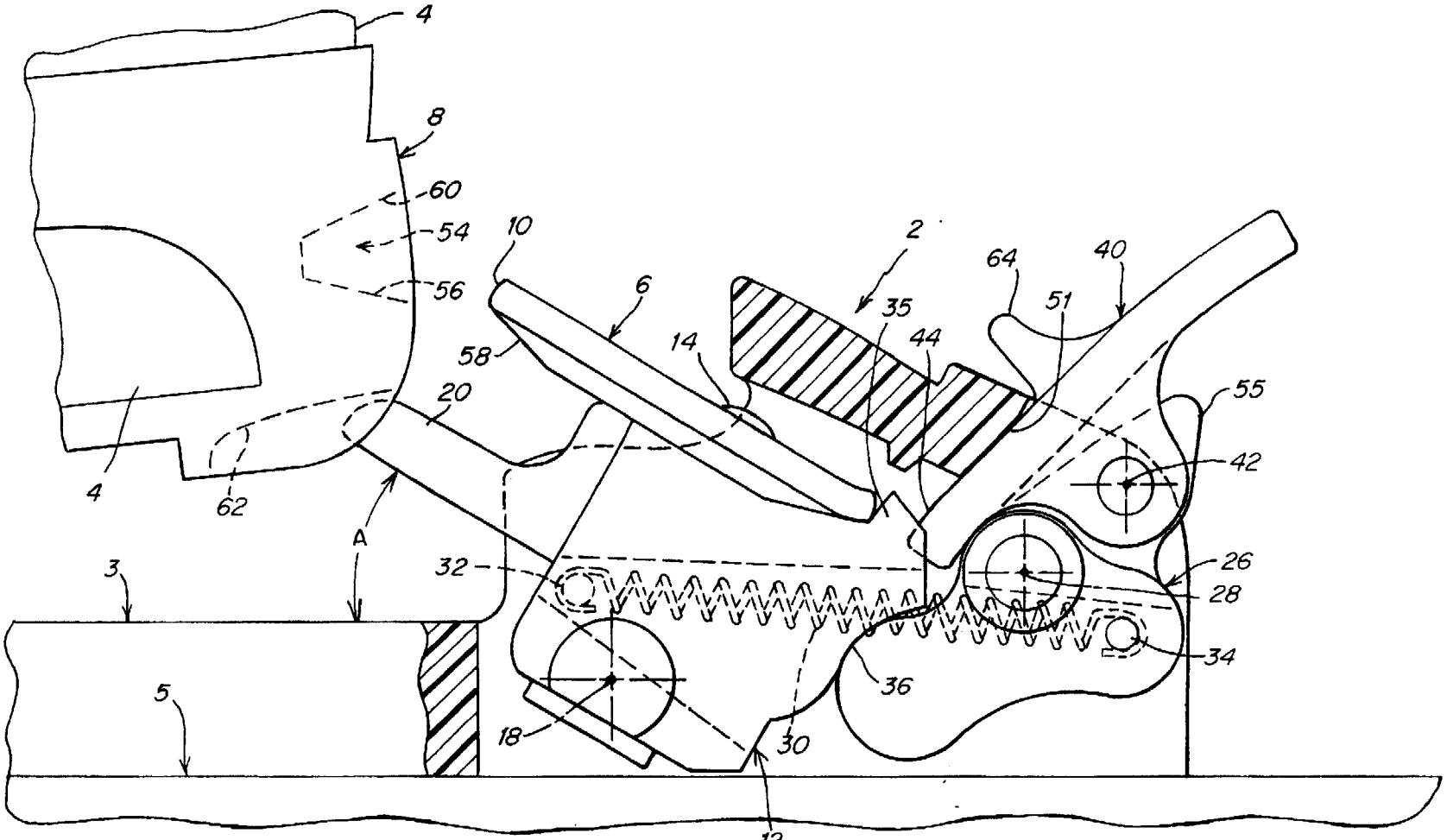
FIG. 3 is a partial rear view of one illustrative embodiment of the binding of FIG. 2, in which the binding cover is removed to illustrate the locking components of the binding.

When the binding is in the open position depicted in FIG. 3, the cam 26 and rocker 12 meet at a contacting surface 36. The binding is held in the open position of FIG. 3 by a pair of tension springs 30 (only one of which is shown in phantom in FIG. 3) that is attached between the rocker 12 and the cam 26, with the springs extending substantially parallel to one another and being spaced apart about a central axis 9 (FIG. 9) of the engagement member 6. The springs are disposed through channels in the rocker 12 and cam 26 and are mounted to rods 32 and 34 respectively disposed in rocker 12 and cam 26. The springs 30 act to pull the rods 32 and 34 toward one another, thereby causing the rocker 12 and cam 26 to each be biased for clockwise rotation about their respective axes 18 and 28. Biasing the rocker in the clockwise direction causes the binding to stay in the open position shown in FIG. 3, with the contact 36 between the inwardly curved surface of the rocker and the outwardly curved surface of the cam limiting the amount of clockwise rotation of the rocker and cam. As will be appreciated from the discussion below concerning the manner in which the rocker 12 is mounted within the binding cover 50, the amount of clockwise rotation of the rocker is further limited by engagement between an upper section 35 of the rocker and an inner surface 112 (FIG. 10) that defines an opening 137 in the binding cover.

The binding handle 40 is pivotally mounted to the cam 26 about a rod 42, which is mounted through holes in the cam and the handle as discussed below, and provides an axis of rotation for the handle relative to the cam. The handle is biased in the clockwise direction by a torsion spring (not shown) wrapped around the rod 42. In the open position, a lip 164 (FIG. 9) of the inner end 44 of the handle is received in a recess 37 (FIG. 9) in the section 35 of the rocker 12. Furthermore, the upper surface of the handle adjacent its inner end 44 contacts an inner surface 51 (FIGS. 7–9) of the binding cover, which limits clockwise rotation of the handle 40 when the binding is in the open position.

Figure 4:
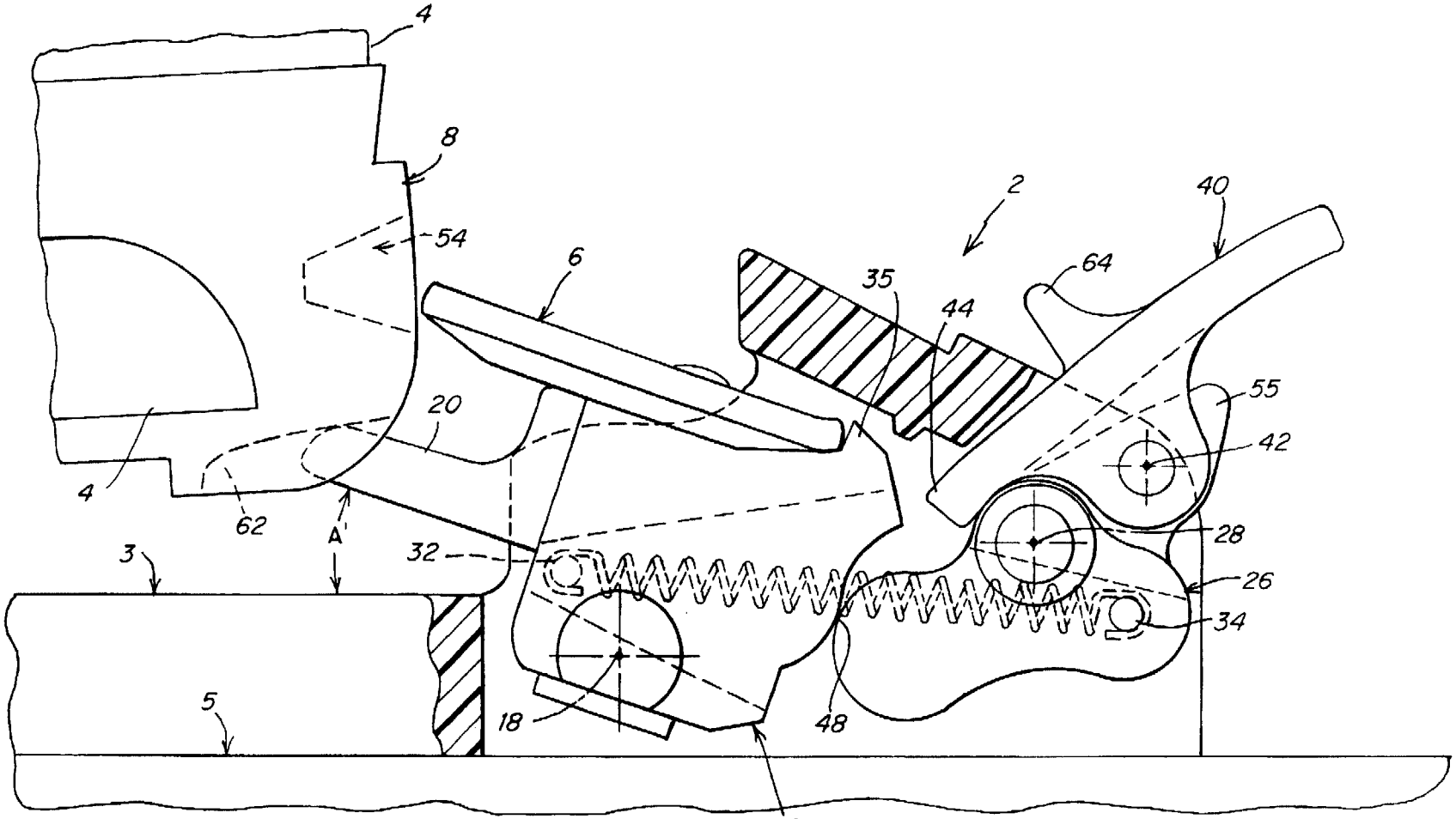
FIG. 4 is a partial rear view of the boot and binding of FIG. 3 in which the boot has partially engaged the binding trigger.

FIG. 4 illustrates the movement of the locking components as the rider steps into the binding and onto the trigger 20. In FIG. 4, the inner surface of the trigger recess 62 of the rider's boot 4 has contacted and displaced the trigger 20, and consequently the rocker 12 and engagement member 6 fixed thereto, approximately ten degrees in the counterclockwise direction so that the angle A' between the bottom of the trigger and the binding plate is approximately twenty degrees. As stated above, the cam 26 is biased in the clockwise direction by the pair of springs 30. Because of the contours of the outer surface of the rocker 12 and the inner surface of the cam 26, rotation of the rocker in the counterclockwise direction permits the cam to rotate in the clockwise direction while remaining in contact with the rocker at 48. If the rider were to lift the boot up away from the binding when in the position shown in FIG. 4, the force of the tension springs 30 would cause the binding to revert to the open position of FIG. 3.

Figure 5:
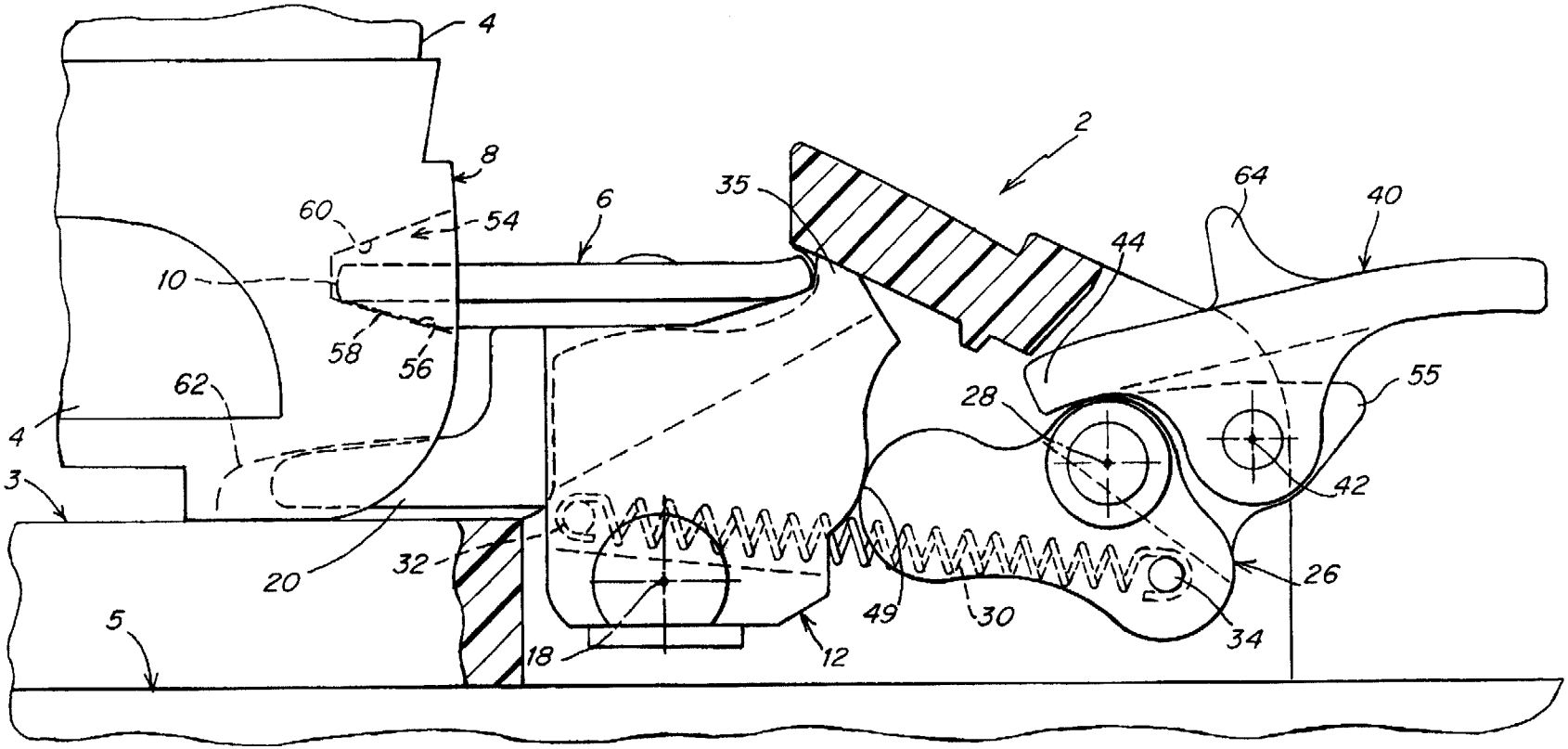
FIG. 5 is a partial rear view of the boot and binding of FIGS. 3–4, in which the boot has fully engaged the binding and moved the binding to a bistable position.

As the trigger 20 is further depressed by the rider's boot, the rocker 12 continues to rotate in the counterclockwise direction, which in turn permits the cam 26 to rotate further clockwise under the force of the tension springs 30. FIG. 5 illustrates the configuration of the binding when the rider has completed the process of stepping into the binding and the trigger 20 is rotated fully forward to a position wherein it is substantially parallel with the snowboard. Thus, the bottom surface of the boot interface 8 lies flat on the binding plate 3, with the trigger 20 being received in the recess 62. In the configuration of FIG. 5, the contact 49 between the cam 26 and the rocker 12 is unstable, in that the cam is not locked into a fixed engagement with the rocker in this configuration. From this position, the force of the tension springs 30 automatically causes the cam to snap into the position shown in FIG. 6, in which the binding is configured in an over-center arrangement that locks the engagement member 6 into position in the boot recess 54 to lock the boot into the binding.

Figure 6:
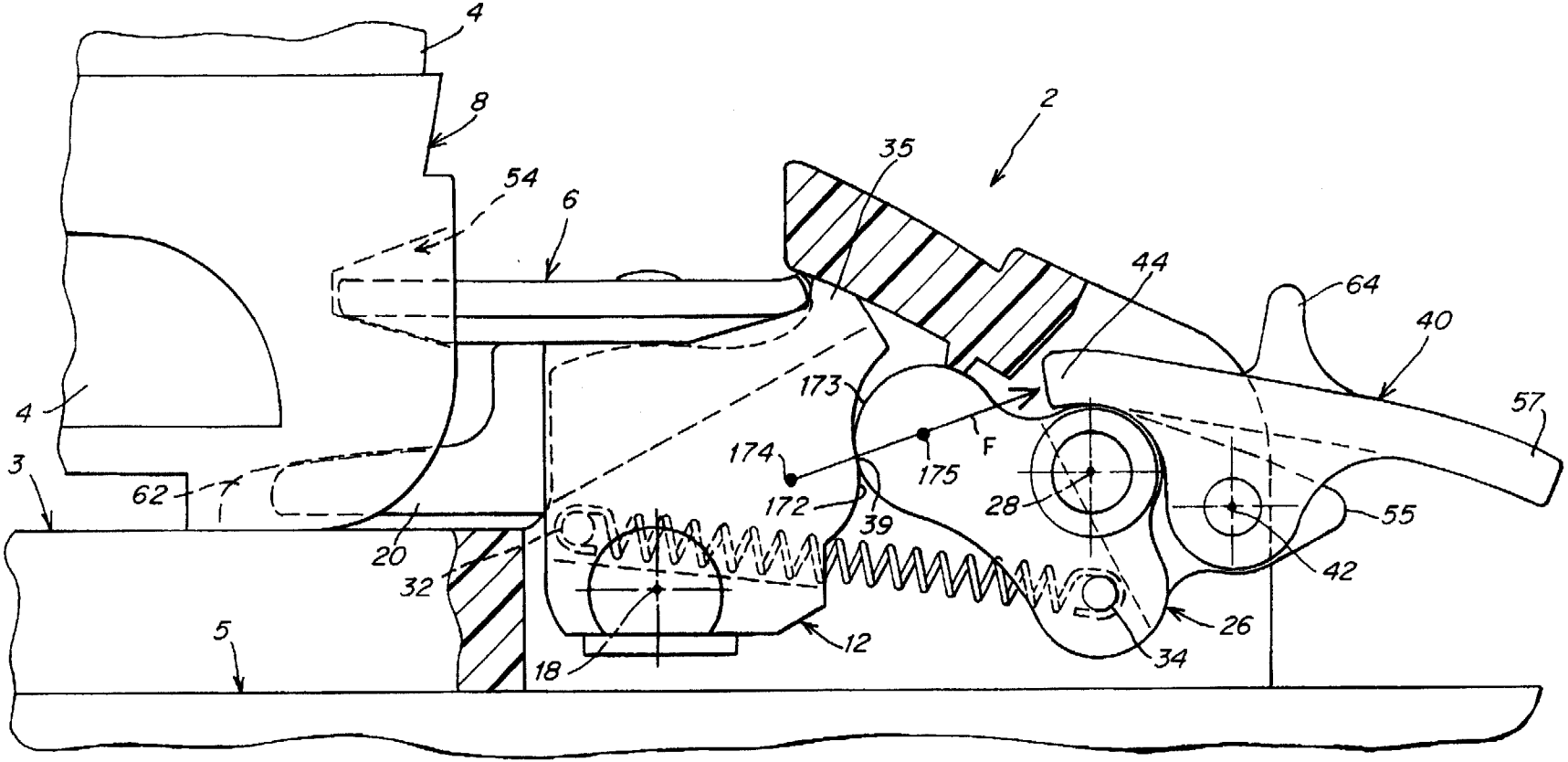
FIG. 6 is a partial rear view of the boot and binding of FIGS. 3–5, in which the cam has moved into an over-center position to lock the binding in the closed position.

In the fully locked position of FIG. 6, the rocker 12 and cam 26 meet at contact surface 39, wherein the outer curved surface 172 of the rocker mates with the inwardly curved surface 173 of the cam. The contact surface 39 is a linear surface that is tangent to each of the two contacting curved surfaces 172 and 173. As will be appreciated by those skilled in the art, the line of force generated on the rocker and cam by the linear contact surface between them extends normally from the contact surface 39, which is tangent to the curved surfaces. Thus, when a lifting force from the boot is generated that would tend to rotate the rocker clockwise into an open position, the rocker translates the force along a force line F that extends between the centers 174 and 175 of the curved surfaces 172 and 173, as shown in FIG. 6. This force tends to rotate the cam clockwise about its pivot axis 28, ensuring that the binding stays closed. Thus, once the binding assumes the closed and over-center configuration of FIG. 6, no amount of lifting force on the rocker will open the binding because such forces act to keep the binding closed.

As seen from the foregoing, the shapes and configurations of the rocker 12 and cam 26 ensure that the binding will remain locked, such that the tension springs 30 are not necessary to keep the binding locked. In this regard, once the binding is locked, it would stay in this position even if the springs were not present. Thus, the springs 30 need only provide sufficient force to hold the binding open as discussed above in connection with FIGS. 2 and 3, and to snap the cam into the over-center position from the unstable position of FIG. 5 when the trigger is fully depressed.

It should be understood that the present invention is not limited to the particular configurations of the rocker 12 and cam 26 shown in the figures, as other configurations are possible that would achieve the same results.

As discussed above, when the binding is in the open position of FIG. 3, clockwise rotation of the handle 40 is limited by engagement with the binding cover 50. However, as the cam 26 rotates from the open position to the over-center position of FIG. 6, the axis 42 about which the handle 40 is mounted to the cam rotates about the cam axis 28 in a clockwise direction until the inner end 44 of the handle clears the inner surface 51 of the binding cover 50, as best shown in FIG. 7. As a result, when the cam snaps to the over-center position and the end 44 of the handle clears the cover edge 51, the handle is free to pivot clockwise about its axis 42 under the force of the torsion spring. Clockwise rotation of the handle 40 in this closed configuration is limited by engagement with an outer section 55 of the cam. The section 55 of the cam and the handle are configured so that when they engage, the handle sits flush with the binding cover along the outer surface of the binding as shown in FIG. 7. This provides a visual cue to the rider that the binding is fully closed and in a ready to ride position. In this position, the free end 57 of the handle is positioned quite close to the surface 52 of the snowboard (e.g., approximately one quarter inch), thereby minimizing the risk of branches, snow or other objects getting underneath the handle and lifting it inadvertently to release the binding while riding.

Figure 8:
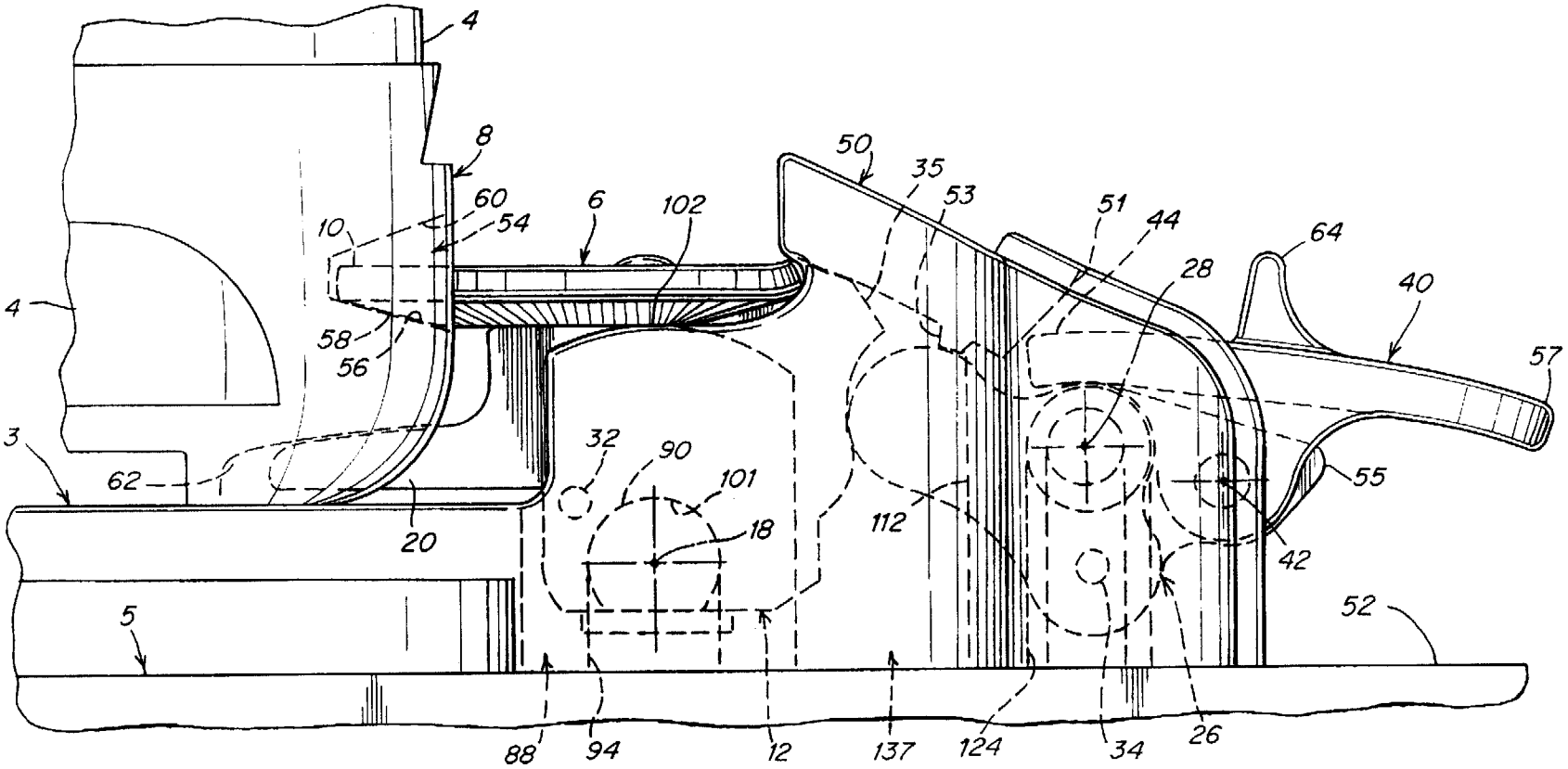
FIG. 8 is the partial rear view of the boot and binding of FIGS. 3–7 with the binding in the closed position and the handle in the ready to open position.

The binding cover 50 is shown in FIGS. 7 and 8, with the rocker 12, cam 26 and the inner surface 51 of the cover being shown in phantom. The inner surface 51 of the binding cover includes a flange 53 that serves two purposes. First, the flange acts to limit rotation of the cam 26 in the clockwise direction when the binding is in the closed position. Second, the flange is adapted to be contacted by the cam when the cam snaps into the over-center position, thereby creating a popping sound that provides an audio indication to the rider that the binding is in the locked and ready to ride position.

To move the binding into the open position to release the boot, the rider lifts the handle 40 to rotate it in the clockwise direction about its pivot axis 42. As discussed above, the end 54 of the handle is disposed close to the surface 52 of the snowboard 55 when the binding is in the closed position. Thus, to facilitate the positioning of the rider's fingers under the end 57, the handle includes a flange 64 that can be used to rotate the handle to a ready to open position shown in FIG. 8, making it easier to fit the rider's fingers under the handle. As discussed above, the handle includes a torsion spring that biases it in the clockwise direction so that if the rider releases the handle when in the position of FIG. 8, the handle reverts back to the ready to ride position of FIG. 7.

To open the binding, the rider lifts the free end 57 of the handle 40 so that the inner end 44 of the handle contacts the cam 26 at a location 61 that is disposed on the opposite side of the cam pivot axis 28 from the axis 42 about which the handle rotates. Thus, as the handle is rotated further in the counterclockwise direction, the engagement with the inner end 44 of the handle causes the cam 26 to rotate counterclockwise about its pivot axis 28. Once the cam reaches the bistable position of FIG. 5, the binding is no longer in an over-center position such that a light lifting force applied on the side of the rider's boot that engages the pivotal engagement member 6 causes the rocker 12 to rotate clockwise into the open position of FIG. 3. Once the end of engagement member 6 clears the recess 54, the rider can simply step out of the binding. The tension springs 30 bias the binding to keep it in the open configuration of FIG. 2, so that the binding automatically assumes a configuration wherein it is ready to receive the rider's boot.

As should be appreciated from the foregoing, the over-center configuration of the binding of the present invention provides secure engagement of the rider's boot, such that the binding will not inadvertently open during riding. Furthermore, a relatively small amount of force is necessary for the rider to open the binding when desired. To rotate the handle to the open position, the rider must only overcome the relatively small force of the torsion spring that biases the handle, and then generate sufficient force to move the cam out of the over-center position.

Figure 9:
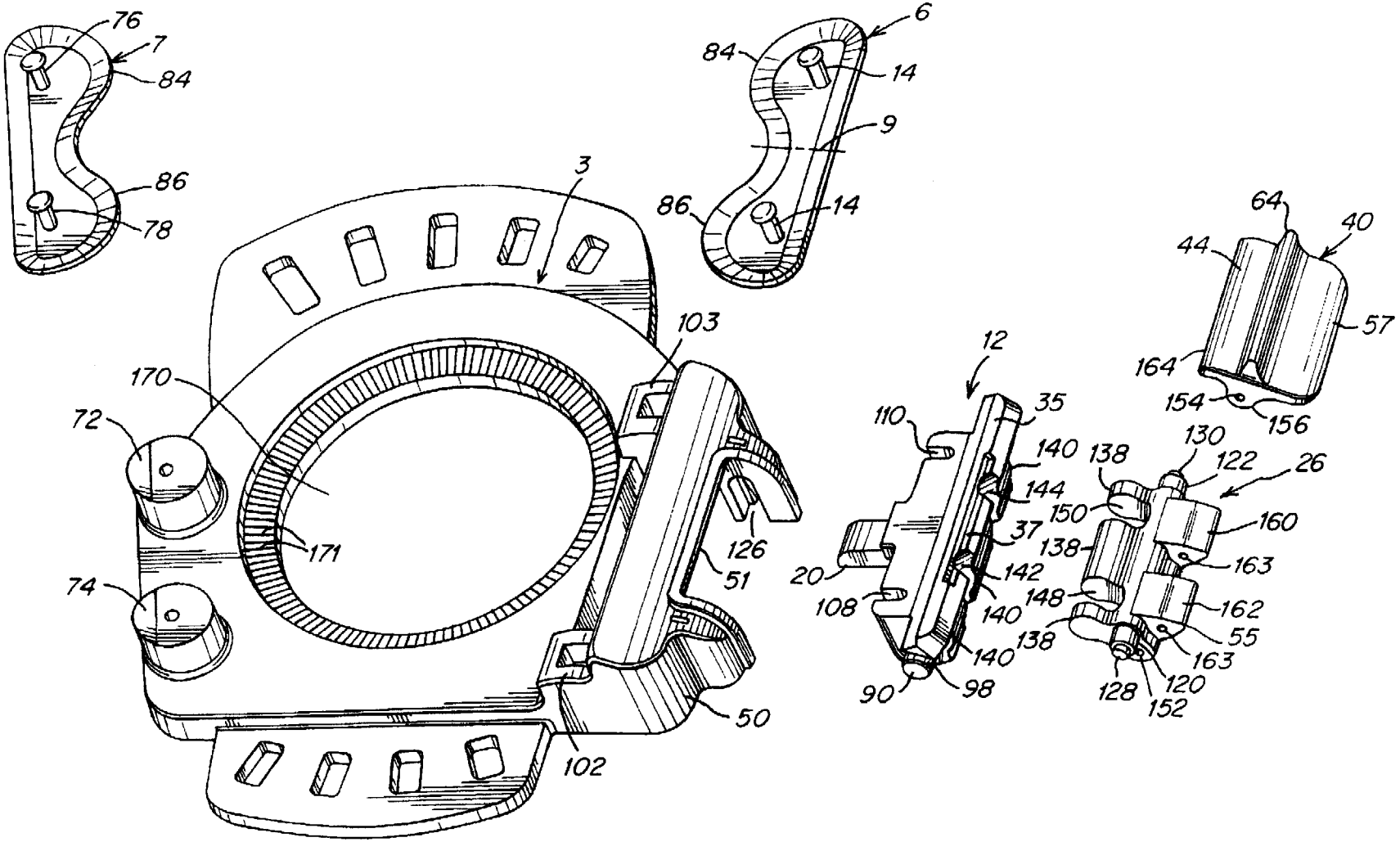
FIG. 9 is an exploded top view of the parts that make up the illustrative binding of FIGS. 3–8.
Figure 10:
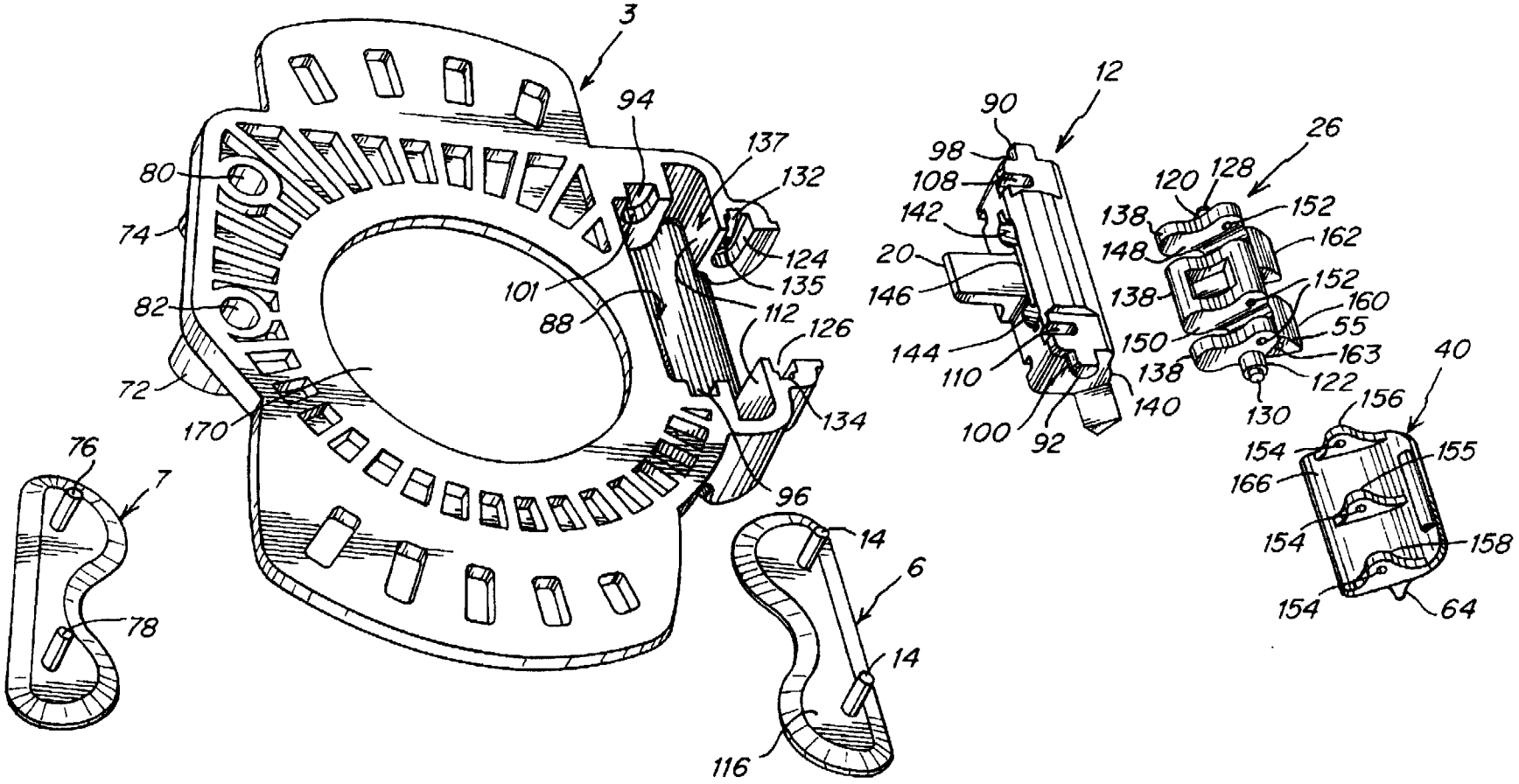
FIG. 10 is a bottom view of the parts of FIG. 9.

FIGS. 9 and 10 are respectively exploded top and bottom views of the various parts that can be used in implementing one illustrative embodiment of the binding of the present invention. The binding cover 50 and binding plate 3 can be formed as a single molded piece of plastic that further includes two substantially hollow posts 72 and 74 for receiving the fixed engagement member 7. The engagement member 7 can be a metal plate that is mounted on the posts 72 and 74 via metal rods 76 and 78 that respectively pass through openings in the posts 72 and 74. The rods can be peened over and attached via a washer disposed within recesses 80 and 82 (FIG. 10) respectively disposed within the posts 72 and 74. It should be understood that the present invention is not limited to any particular technique for attaching the engagement member 7 to the binding, and that other techniques can be used such as press fitting the rods 76 and 78 within bores in the binding housing.

In the embodiment shown, each engagement member 6 and 7 has a pair of engagement fingers 84 and 86 that is adapted to engage two identical recesses 54 (FIG. 7) formed on the lateral sides of the boot. The use of two spaced apart engagement fingers on each side of the boot is advantageous in that it strengthens the engagement between the binding and the boot, particularly when the boot recesses are formed from plastic. However, it should be understood that the present invention is not limited to a binding that uses dual engagement fingers.

As stated above, in one embodiment of the invention the engagement fingers 84 and 86 are angled upwardly to facilitate engagement with the downwardly angled lower recess surface 56 of the boot when the rider is stepping into the binding. However, the engagement fingers can be formed in any number of alternate configurations to mate with compatible recesses on the boot, and it should be understood that the present invention is not limited to the particular recess and engagement finger configuration shown in the figures. In the embodiment shown in the figures, the engagement members 6 and 7 are identical to reduce the number of distinct parts in the binding by making it unnecessary to have different engagement member configurations for engaging the inside and outside of the boot.

Binding cover 50 has a opening 88 for receiving the rocker 12. About its pivot axis 18 (FIG. 4), the rocker 12 includes ends 90 and 92 that are adapted to be slidably received in slots 94 and 96 along the inner surface of opening 88. Ends 90 and 92 have curved upper surfaces 98 and 100 for mating with corresponding curved surfaces in the slots 94 and 96 (only the curved surface 101 of slot 94 can be seen in the figures). The radius of curvature of the surfaces 98 and 100 matches the radius of curvature of the inwardly curved surfaces 101 to permit rotation of the rocker with respect to the binding housing through the angle A (FIG. 3) as the binding moves between the closed and open positions. The rocker is held in place in opening 88 by the engagement member 6, which is mounted on the rocker via rods 14 that pass through holes (not shown) in the engagement member and holes 108 and 110 in the rocker, and are fixed underneath the rocker in the same manner as rods 76 and 78 of the fixed engagement member 7 discussed above. Thus, the rocker 12 essentially hangs from the engagement member 6 via pins 114. The engagement member 6 sits atop a pair of housing surfaces 102 and 103 that are curved to enable the bottom surface 116 of the engagement member to slide over the surfaces through the angles of rotation achieved when the binding moves between the open and closed positions. During assembly, the rocker 12 is placed into the housing opening 88, and then the engagement member 6 is attached to the rocker to movably mount the rocker to the housing.

The binding housing also includes a pair of slots 124 and 126 for receiving the cam 26. Cam 26 includes a pair of ends 120 and 122 that are slidably received in slots 124 and 126, respectively. Ends 120 and 122 include small diameter sections 128 and 130 that are respectively snap fit into circular recesses (not shown) at the top of slots 124 and 126 to establish the cam pivot axis 28 (FIGS. 3–8). The slots 124 and 126 have ramps 132 and 134 adapted to slidably receive smaller diameter sections 128 and 130. The ramps are inclined toward and terminate at a lip 135 before the circular recesses that receive the small diameter sections. Thus, as the cam is slid into the slots 124 and 126, the small diameter sections 128 and 130 will contact the surface of the ramp. The binding cover is forced to spread apart slightly to accommodate the sections 128 and 130 until they clear the ramp lips and are snap fit into the circular recesses on the side of the slots 124 and 126.

An opening 137 in the binding cover provides the area in which the cam surface 138 (FIGS. 9 and 10) contacts the rocker surface 140 throughout the range of configurations between the open and closed positions of the binding. As stated above, tension springs 30 (FIG. 3) are attached at one end to the rocker and at the other end to the cam. The springs are attached to the trigger side of the rocker and pass through channels 142 and 144 in the rocker. The springs are attached to a metal rod 32 that is mounted in a groove 146 in the rocker that is disposed below the trigger and intersects both channels 142 and 144. The rod can be press fit in the groove 146. The springs pass through the rocker channels 142 and 144 and into openings 148 and 150 in the cam 26. A bore 152 (FIG. 10) extends through the width of the cam and is adapted to receive a rod 34 that intersects openings 148 and 150 and can be press fit in the bore. The spring ends are attached to the portions of the rod exposed by the openings 148 and 150. It should be understood that the above-described technique for mounting the springs between the rocker and cam is provided merely for illustration, and that numerous other techniques are possible.

The handle 40 is pivotally mounted to the cam 26 via a metal rod 42 (FIGS. 3–6) that defines the handle pivot axis. The rod passes through holes 154 defined in three sections 155, 156 and 158 of the handle, and through bores 163 in the cam. The section 155 of the handle is placed between two outer sections 160 and 162 of the cam, and sections 156 and 158 are respectively positioned outside the cam sections 160 and 162, such that the holes 154 of the three sections of the handle align with the bores 163 in the sections 160 and 162 of the cam. A torsion spring (not shown) is wrapped around the rod and acts against the handle surface 166 (FIG. 10) to bias the handle to the ready to ride position as discussed above.

In the embodiment of the invention shown in the figures, the binding plate 3 includes an opening 170 for receiving a hold-down disc used to mount the binding to the snowboard in any of a number of rotational orientations relative to the snowboard. Ridges 171 in the plate are adapted to mate with corresponding ridges on the hold down disc. An example of a hold-down disc suitable for use with the binding of the present invention is disclosed in U.S. Pat. No. 5,261,689, which is incorporated herein by reference. However, it should be understood that the present invention is not limited to use with this or any other hold-down disc.

The binding of the present invention has been described above as being used to engage a soft snowboard boot. Although well adapted to this application, it should be understood that the present invention is not limited in this respect, and that the binding of the present invention can be used to engage hard snowboard boots, ski boots or any of a number of other types of footwear.

The foregoing description has primarily illustrated a right foot binding. It should be understood that the left binding can simply be a mirror image of the right binding, with the moveable engagement member 6 and handle 40 being disposed on the outside of the foot. Alternatively, the movable engagement member and the handle could be configured on the inside of the binding.

As stated above, a number of the binding components (e.g., the engagement members 6 and 7) can be made from metal. The present invention is not limited to any particular type of metals, but examples include stainless steel, carbon steel and aluminum. Similarly, the molded plastic components can be formed from any suitable material. In one embodiment of the invention, the molded plastic parts are formed from long fiber glass filled materials, such as nylon, polyurethane, polycarbonate and polypropylene. Long fiber glass filled materials are advantageous in that they maintain their impact strength at relatively cold temperatures where other materials may become brittle. However, the present invention is not limited to use with such materials.

Having thus described certain embodiments of the present invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalents thereof.

What is claimed is:

1. A snowboard binding for securing a snowboard boot to a snowboard, the binding having an open position and a closed position, the binding comprising:

a base adapted to receive the snowboard boot;

a first engagement member, pivotally mounted to the base, adapted to engage a first side of the snowboard boot when the binding is in the closed position; and an over-center locking assembly that locks the binding in the closed position, the locking assembly including;

a first locking member, pivotally mounted to the base, that supports the first engagement member and mounts the first engagement member to the base; and a second locking member, mounted to the base for movement between an open configuration and a closed configuration respectively corresponding to the open and closed positions of the binding, the second locking member being arranged to engage the first locking member when the second locking member is in its closed configuration, the first and second locking members being constructed and arranged so that when the binding is in the closed position, a lifting force generated by the boot on the first engagement member acts to maintain the second locking member in the closed configuration.

2. The snowboard binding of claim 1, wherein the first locking member moves between an open configuration corresponding to the binding being in the open position and a closed configuration corresponding to the binding being in the closed position, and wherein the second locking member is constructed and arranged to prevent the first locking member from moving into its open configuration when the second locking member is in its closed configuration.

3. The snowboard binding of claim 2, wherein the first locking member is a rocker pivotally mounted to the base about a first pivot axis, and wherein the second locking member is a cam pivotally mounted to the base about a second pivot axis.

4. The snowboard binding of claim 2, wherein:

the first locking member is arranged to rotate in a first direction about a first pivot axis as the first locking member moves from its open configuration to its closed configuration; and the second locking member is arranged to rotate in a second direction about a second pivot axis as the second locking member moves from its open configuration to its closed configuration, the second direction being opposite the first direction.

5. The snowboard binding of claim 2, wherein the second locking member is positioned in its open configuration when the binding is in the open position, and wherein the second locking member engages the first locking member when each is in its open configuration.

6. The snowboard binding of claim 5, wherein the first and second locking members are arranged to maintain continuous contact as each moves between its open and closed configurations.

7. The snowboard binding of claim 1, wherein the first and second locking members are separately mounted to the base, such that the first locking member is not mounted to the second locking member and the second locking member is not mounted to the first locking member.

8. The snowboard binding of claim 3, wherein the rocker includes an inwardly curved surface and the cam includes an outwardly curved surface, and wherein the rocker and cam are arranged so that when each is in its open configuration, a first portion of the inwardly curved surface of the rocker contacts a first portion of the outwardly curved surface of the rocker.

9. The snowboard binding of claim 8, wherein the rocker includes an outwardly curved surface adjacent the inwardly curved surface, and wherein the rocker and cam are arranged so that when each is in its closed configuration, a portion of the outwardly curved surface of the rocker contacts a second portion of the outwardly curved surface of the cam.

10. The snowboard binding of claim 2, wherein the second locking member is arranged to rotate in a second direction about a second pivot axis as the second locking member moves from its open configuration to its closed configuration, and wherein the first and second locking members are arranged so that when a lifting force is generated by the boot on the first engagement member when the binding is in the closed position, the lifting force tends to cause the second locking member to rotate about the second pivot axis in the second direction.

11. The snowboard binding of claim 1, further comprising a spring attached at a first end to the first locking member and attached at a second end to the second locking member.

12. The snowboard binding of claim 11, wherein the spring is arranged such that when the binding is in the open position, the spring biases the binding to remain in the open position.

13. The snowboard binding of claim 2, further comprising a trigger, mechanically coupled to the first locking member, that is adapted to be contacted by the snowboard boot when the boot steps into the binding and, in response thereto, to cause the first locking member to move from its open configuration to its closed configuration.

14. The snowboard binding of claim 1, further comprising a handle, mechanically coupled to the second locking member, that is constructed and arranged to move the second member out of its closed configuration.

15. The snowboard binding of claim 14, wherein the handle is pivotally mounted to the second locking member.

16. The snowboard binding of claim 15, wherein the handle includes a first end adapted to be grasped to actuate the handle, a second end that is adapted to releasably contact the second locking member, and a central portion that is pivotally mounted to the second locking member.

17. The snowboard binding of claim 16, wherein rotation of the handle in a first direction about its central portion causes the second end of the handle to contact the second locking member, and wherein the binding further includes a spring, mechanically coupled to the handle, that biases the handle for rotation in a second direction that is opposite the first direction.

18. The snowboard binding of claim 15, wherein the handle is constructed and arranged such that the handle does not contact the first locking member.

19. The snowboard binding of claim 1, further comprising a second engagement member, mounted to the base, that is adapted to engage a second side of the snowboard boot when the binding is in the closed position.

20. The snowboard binding of claim 19, wherein the second engagement member is fixed to the base.

21. The snowboard binding of claim 19, in combination with the snowboard boot, wherein the snowboard boot includes a first recess adapted to receive the first engagement member, and a second recess adapted to receive the second engagement member.

22. The combination of claim 21, wherein the binding further comprises a trigger, mechanically coupled to the first locking member, that is adapted to be contacted by the snowboard boot when the boot steps into the binding and, in response thereto, to cause the first locking member to move from its open configuration to its closed configuration, and wherein the snowboard boot further comprises a sole recess adapted to receive the trigger.

23. The combination of claim 21, wherein a lower surface of the first engagement member contacts a lower surface of the first recess when the first engagement member engages the first recess, wherein the lower surface of the first engagement member is angled upwardly away from the base when the binding is in the closed position, and wherein the lower surface of the first recess is angled downwardly toward the base when the snowboard boot is engaged by the binding in the closed position.

24. The snowboard binding of claim 1, wherein the first engagement member and the first locking member are formed from separate components that are attached together.

25. The snowboard binding of claim 6, wherein the first locking member includes a first curved surface and the second locking member includes a second curved surface, the first and second curved surfaces being adapted so that different portions of the surfaces mate as the binding moves from the open position to the closed position.

26. The snowboard binding of claim 1, wherein:

the first locking member moves between an open configuration corresponding to the binding being in the open position and a closed configuration corresponding to the binding being in the closed position;

the first locking member is arranged to rotate in a first direction about a first pivot axis as the first locking member moves from its open configuration to its closed configuration; and the second locking member is arranged to rotate in a second direction about a second pivot axis as the second locking member moves from its open configuration to its closed configuration, the second direction being opposite the first direction.

27. The snowboard binding of claim 6, wherein:

the first locking member is arranged to rotate in a first direction about a first pivot axis as the first locking member moves from its open configuration to its closed configuration; and the second locking member is arranged to rotate in a second direction about a second pivot axis as the second locking member moves from its open configuration to its closed configuration, the second direction being opposite the first direction.

28. The snowboard binding of claim 27, further comprising a handle, mounted to the second locking member, that is constructed and arranged to move the second member out of its closed configuration, the handle being constructed and arranged such that the handle does not contact the first locking member.

29. The snowboard binding of claim 5, further comprising a handle, mounted to the second locking member, that is constructed and arranged to move the second member out of its closed configuration, the handle being constructed and arranged such that the handle does not contact the first locking member.

30. The snowboard binding of claim 1, further comprising a trigger, mechanically coupled to the first locking member, that is adapted to be contacted by the snowboard boot when the boot steps into the binding and, in response thereto, to cause the first locking member to move from its open configuration to its closed configuration.

31. The snowboard binding of claim 1, wherein the locking assembly consists of only two movable locking members, the two movable locking members being the first locking member and the second locking member.

32. The snowboard binding of claim 14, wherein the locking assembly consists of only two movable locking members, the two movable locking members being the first locking member and the second locking member.

33. A snowboard binding for securing a snowboard boot to a snowboard, the binding having an open position and a closed position, the binding comprising:

a base adapted to receive the snowboard boot;

a first engagement member, movably mounted to the base, adapted to engage a first lateral side of the snowboard boot when the binding is closed; and a locking assembly including:

a first locking member, pivotally mounted to the base about a first pivot axis, that is mechanically coupled to the first engagement member, the first locking member having an open configuration and a closed configuration respectively corresponding to the open and closed positions of the binding;

a second locking member, pivotally mounted to the base about a second pivot axis, that has an open configuration and a closed configuration wherein the second locking member engages the first locking member, the open and closed configurations of the second locking member respectively corresponding to the open and closed positions of the binding; and a spring, attached at a first end to the first locking member and at a second end to the second locking member.

34. The snowboard binding of claim 33, wherein the second locking member is constructed and arranged to prevent the first locking member from moving into its open configuration when the second locking member is in its closed configuration.

35. The snowboard binding of claim 34, wherein the first locking member is a rocker and the second locking member is a cam, wherein the rocker includes an inwardly curved surface and the cam includes an outwardly curved surface, and wherein the rocker and cam are arranged so that when each is in its open configuration, a first portion of the inwardly curved surface of the rocker contacts a first portion of the outwardly curved surface of the rocker.

36. The snowboard binding of claim 34, wherein:

the first locking member is arranged to rotate in a first direction about the first pivot axis as the first locking member moves from its open configuration to its closed configuration; and the second locking member is arranged to rotate in a second direction about the second pivot axis as the second locking member moves from its open configuration to its closed configuration, the second direction being opposite the first direction.

37. The snowboard binding of claim 34, wherein the second locking member engages the first locking member when each is in its open configuration.

38. The snowboard binding of claim 37, wherein the first and second locking members are arranged to maintain continuous contact as each moves between its open and closed configurations.

39. The snowboard binding of claim 33, wherein the first and second locking members are separately mounted to the base, such that the first locking member is not mounted to the second locking member and the second locking member is not mounted to the first locking member.

40. The snowboard binding of claim 35, wherein the rocker includes an outwardly curved surface adjacent the inwardly curved surface, and wherein the rocker and cam are arranged so that when each is in its closed configuration, a portion of the outwardly curved surface of the rocker contacts a second portion of the outwardly curved surface of the cam.

41. The snowboard binding of claim 34, wherein the second locking member is arranged to rotate in a second direction about the second pivot axis as the second locking member moves from its open configuration to its closed configuration, and wherein the first and second locking members are arranged so that when a lifting force is generated by the boot on the first engagement member when the binding is in the closed position, the lifting force tends to cause the second locking member to rotate about the second pivot axis in the second direction.

42. The snowboard binding of claim 33, wherein the spring is arranged such that when the binding is in the open position, the spring biases the binding to remain in the open position.

43. The snowboard binding of claim 34, further comprising a trigger, mechanically coupled to the first locking member, that is adapted to be contacted by the snowboard boot when the boot steps into the binding and, in response thereto, to cause the first locking member to move from its open configuration to its closed configuration.

44. The snowboard binding of claim 33, further comprising a handle, mechanically coupled to the second locking member, that is constructed and arranged to move the second member out of its closed configuration.

45. The snowboard binding of claim 44, wherein the handle is pivotally mounted to the second locking member.

46. The snowboard binding of claim 45, wherein the handle includes a first end adapted to be grasped to actuate the handle, a second end that is adapted to releasably contact the second locking member, and a central portion that is pivotally mounted to the second locking member.

47. The snowboard binding of claim 46, wherein rotation of the handle in a first direction about its central portion causes the second end of the handle to contact the second locking member, and wherein the binding further includes a spring, mechanically coupled to the handle, that biases the handle for rotation in a second direction that is opposite the first direction.

48. The snowboard binding of claim 45, wherein the binding has an unstable position between the closed and open positions, wherein the second locking member has an unstable configuration corresponding to the unstable position of the binding, and wherein the handle is constructed and arranged such that the handle does not contact the first locking member when the handle moves the second locking member from its closed configuration to its unstable configuration.

49. The snowboard binding of claim 33, further comprising a second engagement member, mounted to the base, that is adapted to engage a second side of the snowboard boot when the binding is in the closed position.

50. The snowboard binding of claim 49, wherein the second engagement member is fixed to the base.

51. The snowboard binding of claim 49, in combination with the snowboard boot, wherein the snowboard boot includes a first recess adapted to receive the first engagement member, and a second recess adapted to receive the second engagement member.

52. The snowboard binding of claim 33, wherein the first engagement member and the first locking member are formed from separate components that are attached together.

53. The snowboard binding of claim 38, wherein the first locking member includes a first curved surface and the second locking member includes a second curved surface, the first and second curved surfaces being adapted so that different portions of the surfaces mate as the binding moves from the open position to the closed position.

54. The snowboard binding of claim 33, wherein:

the first locking member is arranged to rotate in a first direction about the first pivot axis as the first locking member moves from its open configuration to its closed configuration; and the second locking member is arranged to rotate in a second direction about the second pivot axis as the second locking member moves from its open configuration to its closed configuration, the second direction being opposite the first direction.

55. The snowboard binding of claim 38, wherein:

the first locking member is arranged to rotate in a first direction about the first pivot axis as the first locking member moves from its open configuration to its closed configuration; and the second locking member is arranged to rotate in a second direction about the second pivot axis as the second locking member moves from its open configuration to its closed configuration, the second direction being opposite the first direction.

56. The snowboard binding of claim 55, wherein the binding has an unstable position between the closed and open positions, wherein the second locking member has an unstable configuration corresponding to the unstable position of the binding, and wherein the binding further comprises a handle, mounted to the second locking member, that is constructed and arranged to move the second member out of its closed configuration, the handle being constructed and arranged such that the handle does not contact the first locking member when the handle moves the second locking member from its closed configuration to its unstable configuration.

57. The snowboard binding of claim 36, wherein the binding has an unstable position between the closed and open positions, wherein the second locking member has an unstable configuration corresponding to the unstable position of the binding, and wherein the binding further comprises a handle, mounted to the second locking member, that is constructed and arranged to move the second member out of its closed configuration, the handle being constructed and arranged such that the handle does not contact the first locking member when the handle moves the second locking member from its closed configuration to its unstable configuration.

58. The snowboard binding of claim 33, further comprising a trigger, mechanically coupled to the first locking member, that is adapted to be contacted by the snowboard boot when the boot steps into the binding and, in response thereto, to cause the first locking member to move from its open configuration to its closed configuration.

59. The snowboard binding of claim 33, wherein the locking assembly consists of only two movable locking members, the two movable locking members being the first locking member and the second locking member.

60. The snowboard binding of claim 44, wherein the locking assembly consists of only two movable locking members, the two movable locking members being the first locking member and the second locking member.

61. A snowboard binding for securing a snowboard boot to a snowboard, the binding having an open position and a closed position, the binding comprising:

a base adapted to receive the snowboard boot;

a first engagement member, movably mounted to the base, adapted to engage a first lateral side of the snowboard boot when the binding is in the closed position; and a locking assembly including;

a first locking member, pivotally mounted to the base about a first pivot axis, that is mechanically coupled to the first engagement member, the first locking member having an open configuration and a closed configuration respectively corresponding to the open and closed positions of the binding, the first locking member being arranged to rotate about the first pivot axis in a first direction as the first locking member moves from its open configuration to its closed configuration; and a second locking member, pivotally mounted to the base about a second pivot axis, that has an open configuration and a closed configuration respectively corresponding to the open and closed positions of the binding, the second locking member being adapted to engage the first locking member when each is in its closed configuration, the second locking member being separately mounted to the base from the first locking member, such that the first locking member is not mounted to the second locking member and the second locking member is not mounted to the first locking member, the second locking member being arranged to pivot about the second pivot axis in a second direction as the second locking member moves from its open configuration to its closed configuration, the second direction being opposite the first direction, wherein the first and second locking members are arranged so that when a lifting force is generated by the boot on the first engagement member when the binding is in the closed position, the lifting force tends to cause the second locking member to rotate about the second pivot axis in the second direction.

62. A snowboard binding for securing a snowboard boot to a snowboard, the binding having an open position and a closed position, the binding comprising:

a base adapted to receive the snowboard boot;

a first engagement member, movably mounted to the base, adapted to engage a first lateral side of the snowboard boot when the binding is in the closed position;

a non-releasable locking assembly including;

a first locking member, pivotally mounted to the base about a first pivot axis, that is mechanically coupled to the first engagement member, the first locking member having an open configuration and a closed configuration respectively corresponding to the open and closed positions of the binding, the first locking member being arranged to rotate about the first pivot axis in a first direction as the first locking member moves from its open configuration to its closed configuration; and a second locking member, pivotally mounted to the base about a second pivot axis, that has an open configuration and a closed configuration respectively corresponding to the open and closed positions of the binding, the second locking member being adapted to engage the first locking member when each is in its closed configuration, the second locking member being separately mounted to the base from the first locking member, such that the first locking member is not mounted to the second locking member and the second locking member is not mounted to the first locking member, the second locking member being arranged to pivot about the second pivot axis in a second direction as the second locking member moves from its open configuration to its closed configuration, the second direction being opposite the first direction.

63. The snowboard binding of claim 62, wherein the locking assembly consists of only two movable locking members, the two movable locking members being the first locking member and the second locking member.

64. The snowboard binding of claim 62, wherein the second locking member engages the first locking member when each is in its open configuration.

65. The snowboard binding of claim 64, wherein the first and second locking members are arranged to maintain continuous contact as each moves between its open and closed configurations.

66. A snowboard binding for securing a snowboard boot to a snowboard, the binding having an open position and a closed position, the binding comprising:

a base adapted to receive the snowboard boot;

a first engagement member, movably mounted to the base, adapted to engage a first lateral side of the snowboard boot when the binding is in the closed position;

a locking assembly including;

a first locking member, pivotally mounted to the base about a first pivot axis, that is mechanically coupled to the first engagement member, the first locking member having an open configuration and a closed configuration respectively corresponding to the open and closed positions of the binding, the first locking member being arranged to rotate about the first pivot axis in a first direction as the first locking member moves from its open configuration to its closed configuration; and a second locking member, pivotally mounted to the base about a second pivot axis, that has an open configuration and a closed configuration respectively corresponding to the open and closed positions of the binding, the second locking member being adapted to engage the first locking member when each is in its closed configuration, the second locking member being separately mounted to the base from the first locking member, such that the first locking member is not mounted to the second locking member and the second locking member is not mounted to the first locking member, the second locking member being arranged to pivot about the second pivot axis in a second direction as the second locking member moves from its open configuration to its closed configuration, the second direction being opposite the first direction; and a trigger, mechanically coupled to the first locking member, that is adapted to be contacted by the snowboard boot when the boot steps into the binding and, in response thereto, to cause the first locking member to move from its open configuration to its closed configuration.

67. The snowboard binding of claim 62, further comprising a second engagement member, mounted to the base, that is adapted to engage a second side of the snowboard boot when the binding is in the closed position.

68. The snowboard binding of claim 67, wherein the second engagement member is fixed to the base.

69. The snowboard binding of claim 62, wherein the first engagement member and the first locking member are formed from separate components that are attached together.

70. The snowboard binding of claim 69, wherein the binding has an unstable position between the closed and open positions, wherein the second locking member has an unstable configuration corresponding to the unstable position of the binding, and wherein the binding further comprises a handle, mounted to the second locking member, that is constructed and arranged to move the second member out of its closed configuration, the handle being constructed and arranged such that the handle does not contact the first locking member when the handle moves the second locking member from its closed configuration to its unstable configuration.

71. The snowboard binding of claim 63, wherein the binding has an unstable position between the closed and open positions, wherein the second locking member has an unstable configuration corresponding to the unstable position of the binding, and wherein the binding further comprises a handle, mounted to the second locking member, that is constructed and arranged to move the second member out of its closed configuration, the handle being constructed and arranged such that the handle does not contact the first locking member when the handle moves the second locking member from its closed configuration to its unstable configuration.

72. The snowboard binding of claim 65, wherein the binding has an unstable position between the closed and open positions, wherein the second locking member has an unstable configuration corresponding to the unstable position of the binding, and wherein the binding further comprises a handle, mounted to the second locking member, that is constructed and arranged to move the second member out of its closed configuration, the handle being constructed and arranged such that the handle does not contact the first locking member when the handle moves the second locking member from its closed configuration to its unstable configuration.

73. A snowboard binding for securing a snowboard boot to a snowboard, the binding having an open position and a closed position, the binding comprising:

a base adapted to receive the snowboard boot:

a first engagement member, movably mounted to the base, adapted to engage a first lateral side of the snowboard boot when the binding is in the closed position; and a locking assembly including;

a first locking member, pivotally mounted to the base about a first pivot axis, that is mechanically coupled to the first engagement member, the first locking member having an open configuration and a closed configuration respectively corresponding to the open and closed positions of the binding, the first locking member being arranged to rotate about the first pivot axis in a first direction as the first locking member moves from its open configuration to its closed configuration; and a second locking member, pivotally mounted to the base about a second pivot axis, that has an open configuration and a closed configuration respectively corresponding to the open and closed positions of the binding, the second locking member being adapted to engage the first locking member when each is in its closed configuration, the second locking member being separately mounted to the base from the first locking member, such that the first locking member is not mounted to the second locking member and the second locking member is not mounted to the first locking member, the second locking member being arranged to pivot about the second pivot axis in a second direction as the second locking member moves from its open configuration to its closed configuration, the second direction being opposite the first direction, wherein the first locking member is a rocker, and the second locking member is a cam, wherein the rocker includes an inwardly curved surface and the cam includes an outwardly curved surface, and wherein the rocker and cam are arranged so that when each is in its open configuration, a first portion of the inwardly curved surface of the rocker contacts a first portion of the outwardly curved surface of the rocker.

74. The snowboard binding of claim 73, wherein the rocker includes an outwardly curved surface adjacent the inwardly curved surface, and wherein the rocker and cam are arranged so that when each is in its closed configuration, a portion of the outwardly curved surface of the rocker contacts a second portion of the outwardly curved surface of the cam.

75. A snowboard binding for securing a snowboard boot to a snowboard, the binding having an open position and a closed position, the binding comprising:

a base adapted to receive the snowboard boot;

a first engagement member, movably mounted to the base, adapted to engage a first lateral side of the snowboard boot when the binding is in the closed position;

a locking assembly including;

a first locking member, pivotally mounted to the base about a first pivot axis, that is mechanically coupled to the first engagement member, the first locking member having an open configuration and a closed configuration respectively corresponding to the open and closed positions of the binding, the first locking member being arranged to rotate about the first pivot axis in a first direction as the first locking member moves from its open configuration to its closed configuration; and a second locking member, pivotally mounted to the base about a second pivot axis, that has an open configuration and a closed configuration respectively corresponding to the open and closed positions of the binding, the second locking member being adapted to engage the first locking member when each is in its closed configuration, the second locking member being separately mounted to the base from the first locking member, such that the first locking member is not mounted to the second locking member and the second locking member is not mounted to the first locking member, the second locking member being arranged to pivot about the second pivot axis in a second direction as the second locking member moves from its open configuration to its closed configuration, the second direction being opposite the first direction; and a handle, mechanically coupled to the second locking member, that is constructed and arranged to move the second locking member out of its closed configuration.

76. The snowboard binding of claim 75, wherein the handle is pivotally mounted to the second locking member.

77. The snowboard binding of claim 76, wherein the handle includes a first end adapted to be grasped to actuate the handle, a second end that is adapted to releasably contact the second locking member, and a central portion that is pivotally mounted to the second locking member.

78. The snowboard binding of claim 77, wherein rotation of the handle in a first direction about its central portion causes the second end of the handle to contact the second locking member, and wherein the binding further includes a spring, mechanically coupled to the handle, that biases the handle for rotation in a second direction that is opposite the first direction.

79. The snowboard binding of claim 76, wherein the binding has an unstable position between the closed and open positions, wherein the second locking member has an unstable configuration corresponding to the unstable position of the binding, and wherein the handle is constructed and arranged such that the handle does not contact the first locking member when the handle moves the second locking member from its closed configuration to its unstable configuration.

80. The snowboard binding of claim 75, wherein the locking assembly consists of only two movable locking members, the two movable locking members being the first locking member and the second locking member.

81. The snowboard binding of claim 75, wherein the second locking member engages the first locking member when each is in its open configuration.

82. The snowboard binding of claim 81, wherein the first and second locking members are arranged to maintain continuous contact as each moves between its open and closed configurations.

83. The snowboard binding of claim 75, wherein the first engagement member and the first locking member are formed from separate components that are attached together.

* * * * *

UNITED STATES PATENT AND TRADEMARK OFFICE

CERTIFICATE OF CORRECTION

PATENT NO. : 5,722,680
DATED : March 3, 1998
INVENTOR(S) : Dodge, David

It is certified that error appears in the above-identified patent and that said Letters Patent is hereby corrected as shown below:

Column 1,
Line 2, after the title, please add -- This application is a continuation-in-part of Serial no. 08/375,971, filed January 20, 1995, now abandoned. --

Signed and Sealed this

Fourth Day of February, 2003

JAMES E. ROGAN
*Director of the United States Patent and Trademark Office*